US005393282A

United States Patent [19]

Maclean

[11] Patent Number: 5,393,282

[45] Date of Patent: Feb. 28, 1995

[54] SLIDE EXERCISE APPARATUS

[75] Inventor: Colin R. Maclean, Abingdon, Md.

[73] Assignee: Improve Human Performance, Inc., Englewood, Colo.

[21] Appl. No.: 21,088

[22] Filed: Feb. 23, 1993

[51] Int. Cl.[6] ..... A63B 23/04

[52] U.S. Cl. ..... 482/70; 482/51

[58] Field of Search ..... 482/51, 70, 13, 71, 482/148; 434/253

[56] References Cited

U.S. PATENT DOCUMENTS 5,076,571 12/1991 Croce ..... 482/51

5,133,700 7/1992 Braathen ..... 482/51

*Primary Examiner*—Stephen R. Crow

*Attorney, Agent, or Firm*—Fish & Richardson

[57] ABSTRACT

A guide board exercising apparatus has a plurality of bumpers between which a person slides on their feet. The bumpers have an inclined surface which a person's feet contacts. The inclined surface is at an acute angle of approximately 18 to 22 degrees. The bumpers may be permanently attached to a sliding sheet or may be removably clamped to a sheet to permit adjustment of the length of the sliding surface or the relative angle of the bumpers. More than two bumpers are attached to a sliding sheet to form a completely enclosed sliding surface such that a user can exercise by sliding in any direction, in addition to side to side directions. The bumpers have a textured surface to increase friction with a person's feet and have a mounting flange to facilitate connecting the bumpers to the plastic sheet. A non-slip material, attached to the bumpers or sliding sheet, is placed between the sliding sheet and the floor to prevent the apparatus from moving over the floor during use.

44 Claims, 7 Drawing Sheets

4
4
10
25
30
25
10
α

β
13
33
30
14
10
11
12
31
32
25

SLIDE EXERCISE APPARATUS

BACKGROUND OF THE INVENTION

1. Field of the Invention

The present invention relates to slide exercise devices, and in particular to the configuration and positioning of bumpers of slide board type exercise devices.

2. Description of the Related Art

Slide board exercise devices are typified by U.S. Pat. No. 4,779,862 and 5,114,387 to Keppler. These devices were developed primarily as exercisers for speed skaters and similar athletes. The basic apparatus has a rectangular base covered with a plastic sheet. The plastic sheet has a smooth glide surface which is bounded at two sides by a bumper at each end of the sheet. The bumpers are attached to opposite ends of the base along the two shorter sides of the rectangle.

A person wearing the appropriate footwear (socks or shoe covers) slides along the plastic sheet until one foot contacts a bumper. By pushing with the leg contacting the bumper, the person can slide again along the plastic sheet in the other direction until the other foot contacts the second bumper. By alternately pushing off of one bumper towards the other bumper, the person exercises the muscles of the legs and other muscles.

Early prior art slide boards comprised a base and two bumpers. The bumpers were rigid and removable members clamped to the ends of the base. The bumpers were mounted parallel to each other and had vertical surfaces which received the impact of the sliding feet. A problem with the above-mentioned configuration was that the vertical bumpers caused considerable and adverse impact pressures and stresses to be applied to the foot, ankle and knee. During impact, the fifth metatarsal of the foot contacts the rigid vertical wall of the bumper. This initial impact causes bruising of the side of the foot, which eventually results in user discomfort and diminishes the utility of the slide board. If contact with the bumper continues, unwanted lateral pressure increases on the subtalar joint and on the knee, stressing the lateral collateral ligament.

These disadvantages were somewhat addressed in the second patent to Keppler, No. U.S. Pat. No. 5,114,387. This patent discloses a slide board having an inclined plane attached to and adjacent to the bumper. The ramp section of the bumper is made of wood and is inclined at an angle relative to the horizontal such that the ball of the foot, rather than the metatarsal bones, contact the bumper. Thus, side impact pressure and lateral stresses are reduced. On deceleration, the ball of the foot will contact the bumper and the ankle will attempt to evert to the angle of the inclined plane bumper.

The flexibility of a typical ankle will permit a maximum eversion of approximately 20 degrees. Eversion of more than 20 degrees generally causes pain. Medical experts have suggested that the maximum range for the ankle to evert, which is the maximum strain load before injury, is between about 15 and 20 degrees. Prior art inclined bumpers are inclined at an angle of 25 to 40 degrees. Angles of this magnitude were required to create sufficient lateral stopping force. However, impact with such a bumper causes the ankle to evert more than 20 degrees and results in pain. To compensate for the pain, the user changes (decreases) the normal hip height to decrease the angle to which the ankle must evert after impact with the steep ramp. This altered position of the leg and body decreases the effectiveness of the exercise and may lead to other injuries. Thus, the prior art slide board devices have addressed the problems of bruising of the foot and lateral stresses on the ankle and knee, but the solution is unsatisfactory because it causes further stress on the ankle and causes poor body position during exercise.

Another deficiency of the early prior art slide boards is that the bumpers are parallel to each other at the ends of the plastic sheet. However, the tendency of the foot is to naturally turn outward slightly as the user pushes off. Thus, ideally, the bumpers should be toed-out slightly to allow the user to push off comfortably and remain aligned upon the slide board. Prior art slide board exercisers such as U.S. Pat. No. 4,779,862 were designed primarily for speed skating, and provide for a fixed toe-out of 10°. Thus, some prior art slide boards have addressed the need for a toe-out angle to provide for a natural push-off position for the foot, but fail to provide an adjustable toe-out angle or optimum toe-out angles for the motions of specific exercise. A modern slide board exerciser should permit a wide variety of exercises and should permit adjustment to the appropriate toe-out angle.

Yet another deficiency of the prior art is that the slide boards limit the user's motion to lateral side-to-side motions in one direction. The rectangular base is bounded only at two opposing sides, thus giving the user no freedom to exercise by pushing in forward, rearward or diagonal positions.

Yet another deficiency of the prior art is that traditional bumpers are made of wood and comprise a vertical wooden bar with a wooden wedge attached to the vertical surface of the bar. This design requires at least two attachments, one for attaching the bar to the plate, and another for attaching the wedge to the bar. Additional components such as pads between the wedge and the bar function as shock absorbers. Thus, the prior art slide boards have many parts and connections which make the device expensive to manufacture and difficult to assemble and maintain.

SUMMARY OF THE INVENTION

It is an object of the present invention to provide a slide board exercise apparatus which addresses the deficiencies described above. Particularly, it is an object to provide a slide board exerciser that will permit a broad range of activities while minimizing the detrimental stresses and pressures applied to the body during exercise. By reducing the adverse physical impacts of the exercise, there is a lessened chance of injury, thus increasing the effectiveness of the apparatus. Also, by altering the orientation and the number of bumpers, an exercise slide board may be used for a wide variety of exercises and to provide a thorough exercise of many muscle groups.

The angle of the inclination of the bumpers of the present invention is limited to an optimized range or ranges which eliminate or reduce the tendency of the ankle to over-evert upon contact with the bumper. In use, when the user's foot contacts the bumper, the ball of the foot slides onto the inclined plane surface and causes the ankle to evert to an acceptable degree without inducing the user to alter body position. With such an inclined plane, the joints and muscles of the leg are in proper alignment and allow for maximum performance. This feature will reduce the stresses, thus helping to avoid injury and reduce discomfort of the exercise.

Also, by further reducing the angle of inclination, the apparatus is readily usable for rehabilitation of injuries. While having relatively low angles of inclination, the bumper of the present invention also provides sufficient transfer of force to decelerate the user while preventing the foot from sliding up the ramp and over and past the bumper. The surface of the bumper also provides substantial friction to bring the sliding foot to rest while on the inclined plane.

The present invention also provides a toe-out angle which is fixed to an angle specific to a particular exercise or user, or alternatively is adjustable to provide the versatility to be used for a variety of exercises. The fixed toe-out angle is created by forming the appropriate angles in the plastic sheet to which the bumpers are attached. Thus, the user need not measure the appropriate angles and adjust and clamp the bumpers in the correct positions.

Another object of the invention is to further reduce the impact stresses on the feet and the stresses on the joints of the ankle and knee. This is accomplished by increasing the distance over which the foot travels while the user is decelerating and pushing off of the bumper. This type of energy absorption and propulsion more closely approximates the natural and actual motions and forces of the real exercise. This feature is accomplished by attaching each bumper to the base only at the ends of the bumper, thus allowing the middle of the bumper to flex in the sliding direction upon impact.

To further increase the versatility and usefulness of the conventional slide board exerciser, the present invention may alternatively provide the user with a broad range of movement patterns and positions to increase the potential fitness and skill benefits of the apparatus. The toe-out angle and length can be adjusted to conform to the requirement of a particular exercise or user. Also, more than two bumpers may be attached to a plastic slide board to provide an enclosed space. Thus, the user is completely surrounded by bumper boundaries and may push off and move in any direction, not just laterally as in the prior art designs.

Other objects, features and characteristics of the present invention, as well as the methods of operation and function of the related elements of structure, and the combination of parts and economies of manufacture, will become more apparent upon consideration of the following description and the appended claims with references to the accompanying drawings, all of which form a part of this specification, wherein the reference numerals designate corresponding parts in the various figures.

DETAILED DESCRIPTION OF THE PREFERRED EMBODIMENTS

Figure 1:
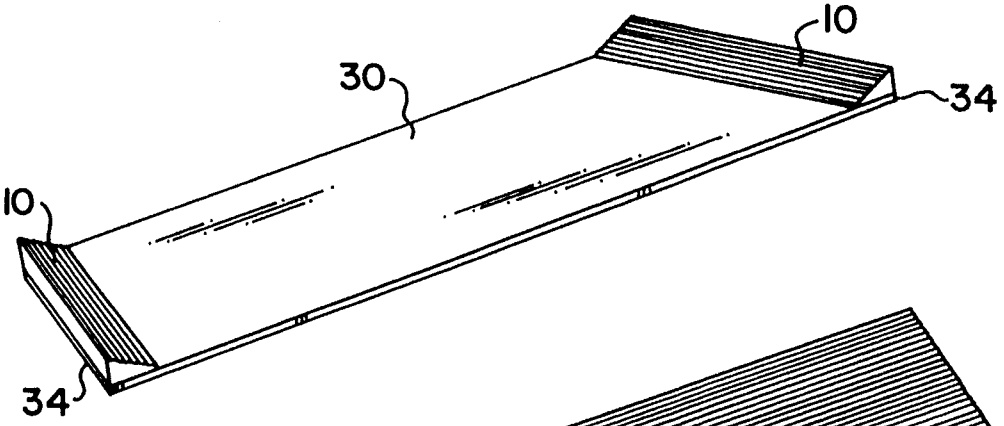
FIG. 1 is a perspective view of a first embodiment of the present invention.

As shown in FIG. 1, the basic construction of the preferred embodiment includes a slide board exercise apparatus having a plastic sheet 30 and a plurality of bumpers 10. A detailed description of the unique components of the present invention, which are combinable in a variety of ways to form the various embodiments of the present invention, follows. Specific embodiments will be described later with reference to the following components.

Figure 2:
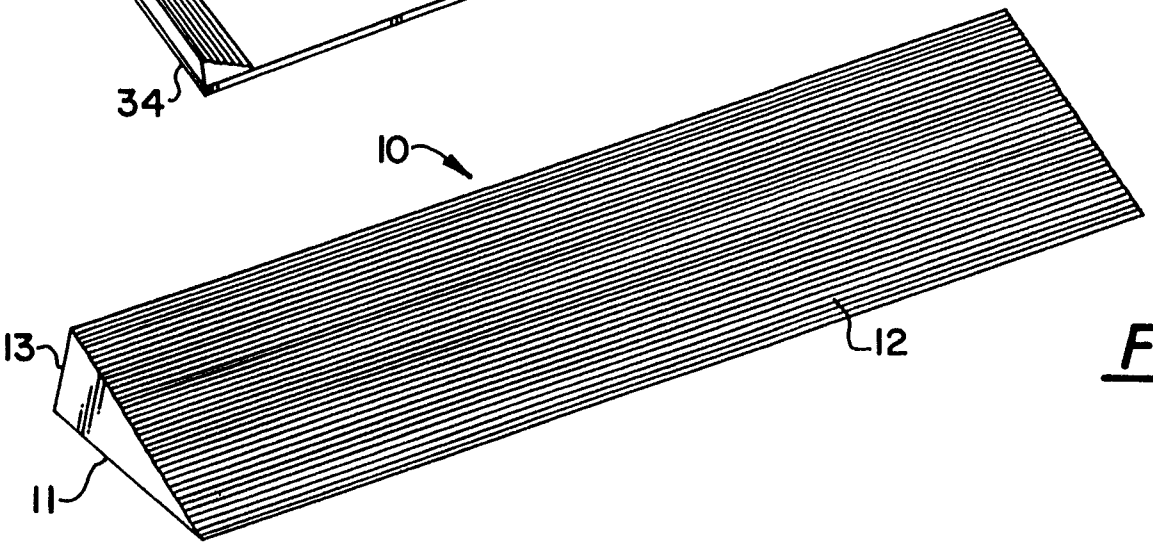
FIG. 2 is a cross-sectional view of a bumper of the embodiment of FIG. 1.
Figure 4:
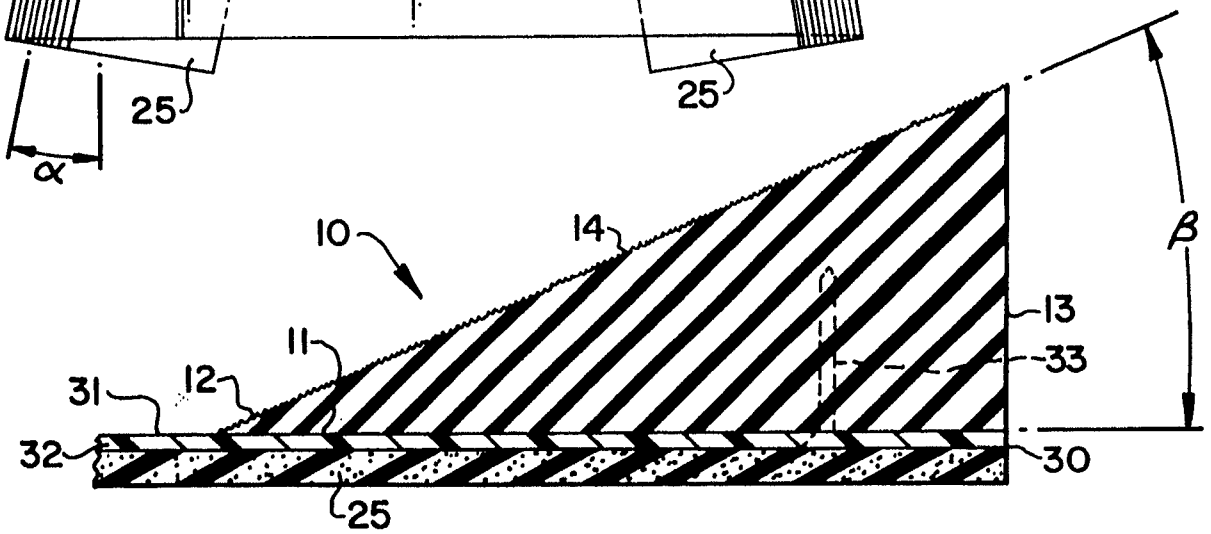
FIG. 4 is a cross section view of FIG. 3 at Line 4—4.
Figure 10:
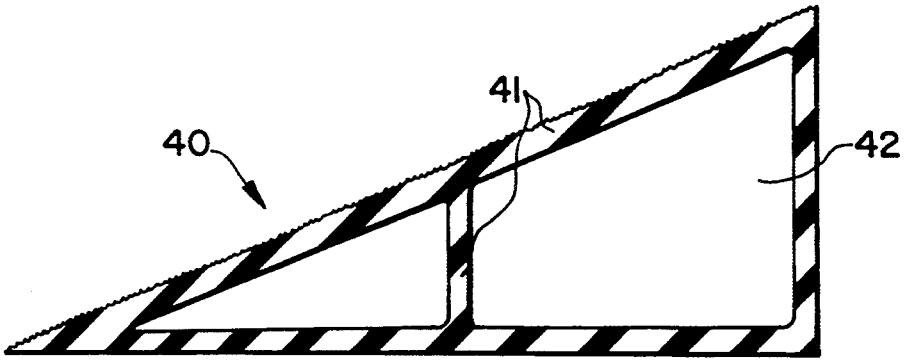
FIG. 10 is a cross sectional view of an alternate embodiment to the bumper of FIG. 4.

The bumper 10 is wedge-shaped, having a bottom surface 11, a contact surface 12 and a back surface 13, as shown in FIG. 2. The bumper is preferably formed as a single piece having a length approximately equal to the width of the sliding surface. The bumper is preferably solid as shown in FIG. 4, or constructed such that there is substantial hollow interior space as shown in FIG. 10. For example, the hollow bumper is made of any rigid or semi-rigid material 41 which forms the surfaces and the interior support, the remainder of the bumper being hollow. The hollow bumper 40 is light-weight and more easily bolted to the plastic sheet due to convenient access to the interior 42 of the hollow bumper.

Preferably, however, the bumper is solid as shown in FIG. 4 and made of any semi-rigid or rigid material, for example, rubber. In profile, the bumper has a right triangular shape with the hypotenuse side of the triangle defining the contact surface 12. The shortest remaining side is the back surface 13, the final side being the bottom surface 11. On a slide board, the bumper is oriented with the bottom surface 11 being flush with the top surface 31 of the plastic sheet 30 and the contact surface facing the contact surface of an opposing bumper as shown in FIG. 1. During use, the user's foot slides across the plastic sheet 30 and contacts the contact surface 12 of the bumper 10. The contact surface 12 is inclined at an angle 13 large enough that the user's foot is brought to a stop, but small enough to prevent over-eversion of the ankle. This angle is in the range of 8 to 22 degrees, depending upon the type and level of exercise performed on the slide board. Angles in the range of 18°–22° are appropriate to optimize performance for training in a variety of different sports. An inclination angle of about 20° is the preferred angle for the combination of stopping force and proper eversion for most exercises. However, for some exercises, angles as small as 18 degrees may still be too great to allow the ankle to evert properly.

Alternately, angles in the range of 8 to 12 degrees are more appropriate for rehabilitation of some injuries. A slide board with low inclined bumpers can thus be used for rehabilitation exercises as well as general strength and skill exercises. Ideally, the angle of inclination should be the least angle necessary while still providing sufficient stopping force to the user's foot.

The bumpers 10 of the present invention may be constructed of a number of materials. The unibody construction avoids the disadvantages associated with a number of connections and different parts common with some prior art bumpers which were connected to the base and also had a wedge and other parts connected to the bumper. The bumpers of the present invention are molded of a rubber or other elastic material which has shock absorption characteristics. Thus, shock from the impact of a foot is absorbed by the material of the bumper itself, not by separate components connected to the bumper system. Any type of rubber or similar shock absorbing material may be used to achieve the proper shock absorbing characteristics. A slide board being used for rehabilitation of injuries may be made of a softer and spongier material to reduce the impact pressures applied to the ball of the foot. However, bumpers for a slide board used for hockey training, for example, are made of a harder, less elastic material.

The deceleration and propulsion forces applied to the contact surface 12 of the inclined plane bumper 10 are not exclusively perpendicular to the surface. Some amount of the force is applied along the contact 12 surface by the frictional forces between the user's foot and the contact surface 12. Thus, the amount of friction generated between the user's foot and the contact surface 12 of the inclined plane bumper 10 is critical to the effectiveness of the bumper. If there is insufficient friction, the user's foot may contact the bottom of the contact surface 12 and continue to slide up the surface 12 and over the bumper 10. This is called a slide-over. It occurs when the bumper provides inadequate force to decelerate the user.

If there is too much friction, the user's foot will contact the bottom of the surface 12 and stop without allowing the foot to slide substantially onto the surface 12. In this situation, the foot is prevented from assuming the proper position for transferring force from the leg through the ball of the foot.

To help stop the user's foot, the contact surface of the bumper 10 has a texture to increase friction with the user's foot. The proper friction is provided by selecting a material and applying an appropriate surface texture 14 so that the foot of a user slides onto, but not over, the contact surface 12 of the bumper 10. The friction surface can be applied as an adhesive tape or compound. Alternatively and preferably, the textured surface 14 is integral with the bumper. For example, bumper made of rubber as shown in FIG. 4, has a textured contact surface comprising small ribs which extend perpendicular to the direction of motion of a user's foot. The textured surface 14 provides a smooth and consistent frictional deceleration of the user's foot, avoiding abrupt stops and slide-overs. The type of material and the texture of the surface of the bumper may be varied according to the specific nature of the exercise and other factors such as the angle of the inclined bumper, the type of shoe or shoe cover worn by the user, the weight of the user and the intensity of the exercise. Also, the texture may vary over the surface of the bumper. For example, as shown in FIG. 4, near the plastic sheet, the contact surface 12 may be essentially smooth, while the surface becomes increasingly textured further up the surface of the bumper. The ridges of the textured surface, for example, may be about 1/64 of an inch high and about 1/32 of an inch apart. Other texture patterns and sizes are, of course, possible.

The plastic sheet 10 has a smooth surface and must have sufficient stiffness and strength to prevent buckling and wrinkling as a user slides across the sheet. The sheet 30 is cut to the appropriate size with the desired angles at the end. Large plastic sheets are formed by welding a number of smaller plastic sheets together to form any shape.

Attaching the bumpers 10 to the plastic sheet 30 is necessary to keep the bumpers 10 from moving when the foot contacts and slides onto the bumper. A number of connection methods are possible to connect any of the bumpers described above to the plastic sheet. One attachment means is to adhere the bumper to the plastic with glue, tape or other adhesive. The adhesive may be permanent or may allow the bumper to be removed. For example, a velcro-type connecting means may be used. A velcro-type connection has an added advantage of providing some shock absorption due to the flexible nature of the velcro connection.

Figure 3:
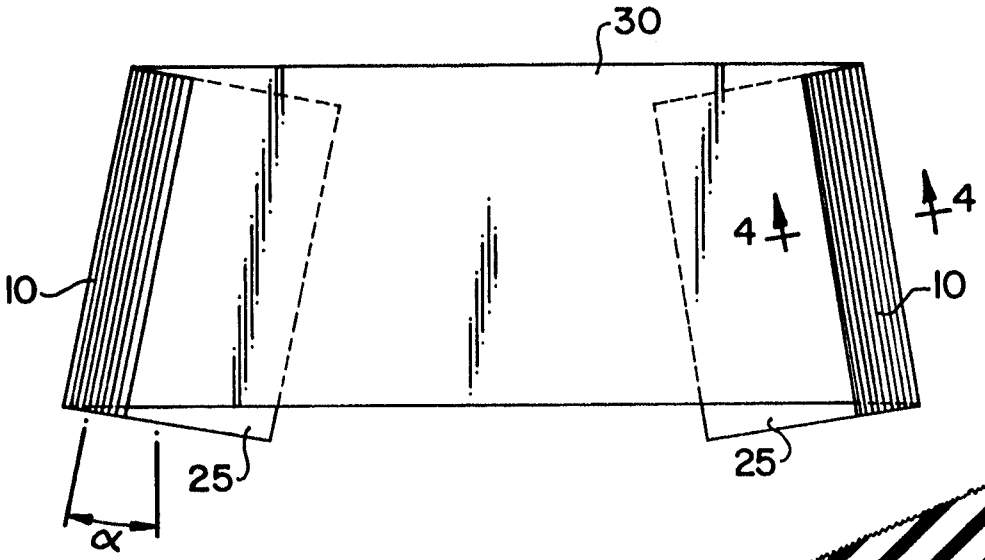
FIG. 3 is a top view of the embodiment of FIG. 1 including friction pads.

Alternatively, the bumpers are attached to the plastic sheet by screws 33, as shown in FIG. 4. Ideally, for a screw attachment, the plastic sheet is cut to the desired length and cut at the ends to provide the appropriate toe-open angles $\alpha$ for the bumpers, as shown in FIG. 3. For example, a plastic sheet may be cut at the ends to have a toe-open angle $\alpha$ in the range of 5 to 8 degrees. Toe-open angles of 5–8 degrees are ideal for desired performance in a number of exercises. However, the bumpers could alternately be attached with no toe-open angle—in which case the bumpers would be parallel.

The plastic sheet has pre-drilled holes for the screws 33. The screws 33 are inserted from the bottom surface 32 of the plastic sheet and screwed into the bumper 10. The bumpers 10 are attached to the ends of the plastic sheet 30 with four screws 33. The length of the slide board, between bumpers, is preferably about 7 feet. The specific toe-open angle $\alpha$ is determined and cut into the plastic based on the particular exercises to be performed. Longer or shorter plastic sheets 30 can be used to provide the proper slide length for various exercises and levels of exercise intensity. Additionally, depending upon the stiffness of the bumpers 10 and the strength of the plastic sheet 30, more or fewer screws 33 may be used. The screws 33 may be removed by the user and the bumpers can then be repositioned on the plastic sheet.

Figure 5:
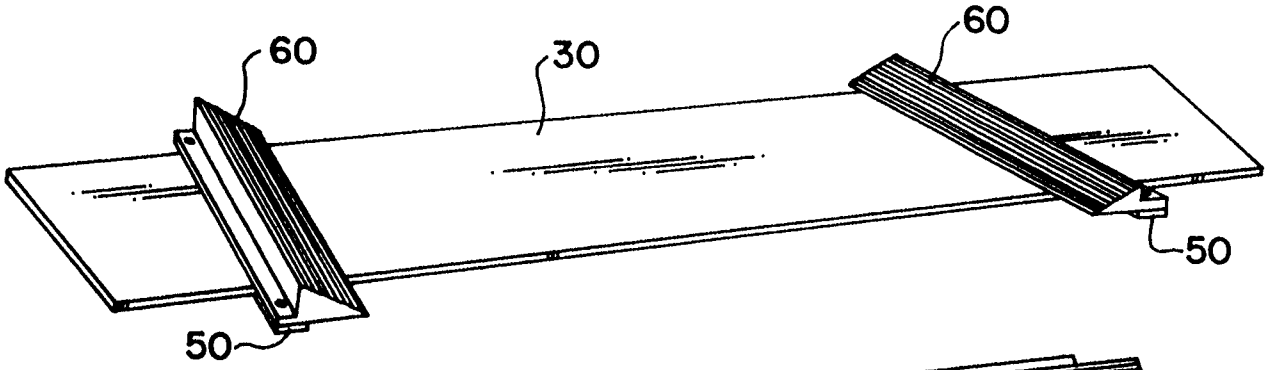
FIG. 5 is a perspective view of a second embodiment of the present invention.
Figure 6:
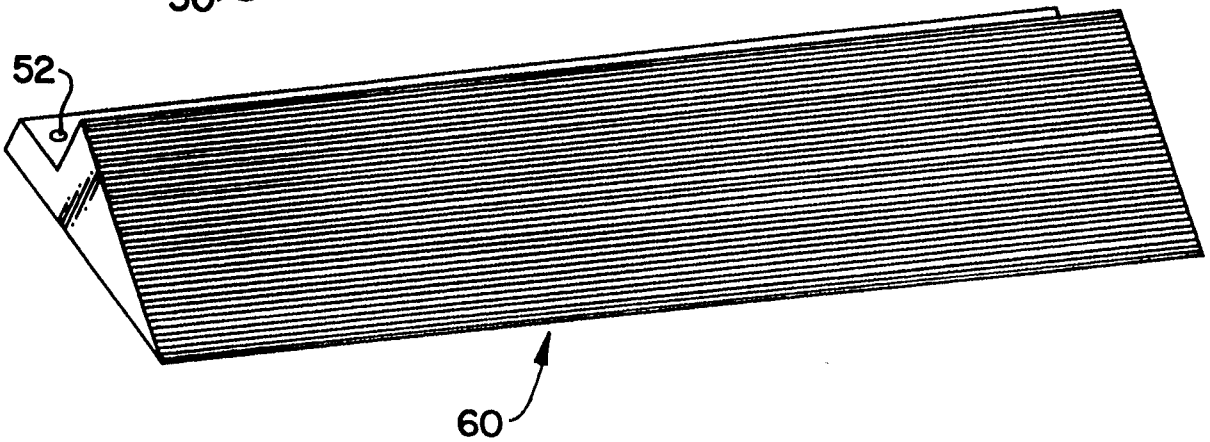
FIG. 6 is a perspective view of a bumper of the embodiment of FIG. 5.
Figure 8:
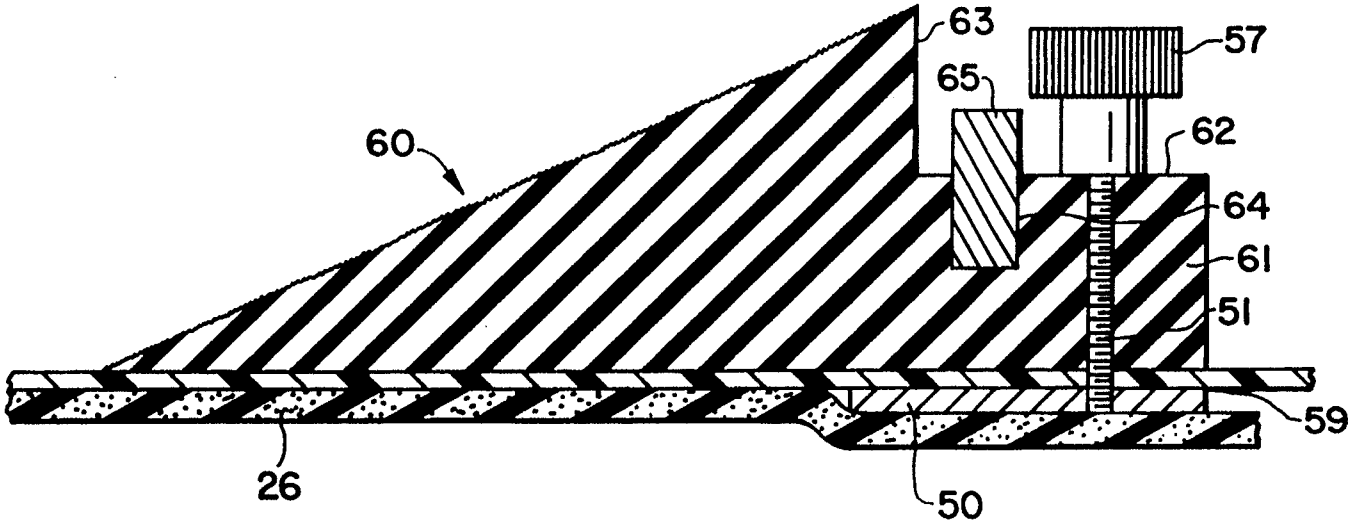
FIG. 8 is a cross section view of FIG. 7 at line 8—8.

A second attachment method, shown in FIGS. 5 and 8, is to clamp the plastic sheet 30 between the bottom surface 11 of the bumper 60 and a top surface 59 of a clamping plate 50. For this attachment system, the bumpers 10 are attached to the clamping plate 50 at the ends of the bumper 10. Any attachment means common in the art may be used, but preferably, the bolts 51 are attached vertically to the ends of the clamping plate 50 and pass through predrilled holes 52 in the bumper 60. The bumpers 60 are longer than the width of the plastic sheet 30 and the holes are spaced by a distance greater than the width of the plastic sheet 30 such that the bolts 51 pass adjacent to the plastic sheet 30 and through the bumper 60. Threaded thumb knobs 57 screw onto the bolts 51 such that when the knobs 57 are tightened, the clamping plate 50 is drawn towards the bottom surface 11 of the bumper 60 clamping the plastic sheet 30 therebetween. Of course, the bolts may be inserted from the top surface of the bumper and screwed into threaded holes in the clamping plate.

The bolts may pass through the top of a wedge-shaped bumper similar to those of FIGS. 1–4. Alternatively and preferably, bumpers mounted with bolts 51 and a clamping plate 50 have a mounting flange portion 61 as shown in FIGS. 5–8. The mounting flange portion 61 is integral with the rest of the bumper and has a horizontal upper surface 62. The mounting flange bumper 60 has a stepped-down mounting flange portion 61 of a smaller thickness than the thickest portion of the wedge-shaped bumper of FIGS. 1–4. The flange 61 protrudes from the back surface 63 of the wedge. The bolts pass through the flange portion 61 which has a horizontal surface 62 against which the heads of the thumb knobs 57 abut. The protruding mounting flange portion 61 provides easy access to the attachment mechanism and allows for vertical placement of the screws or bolts 61.

Figure 7:
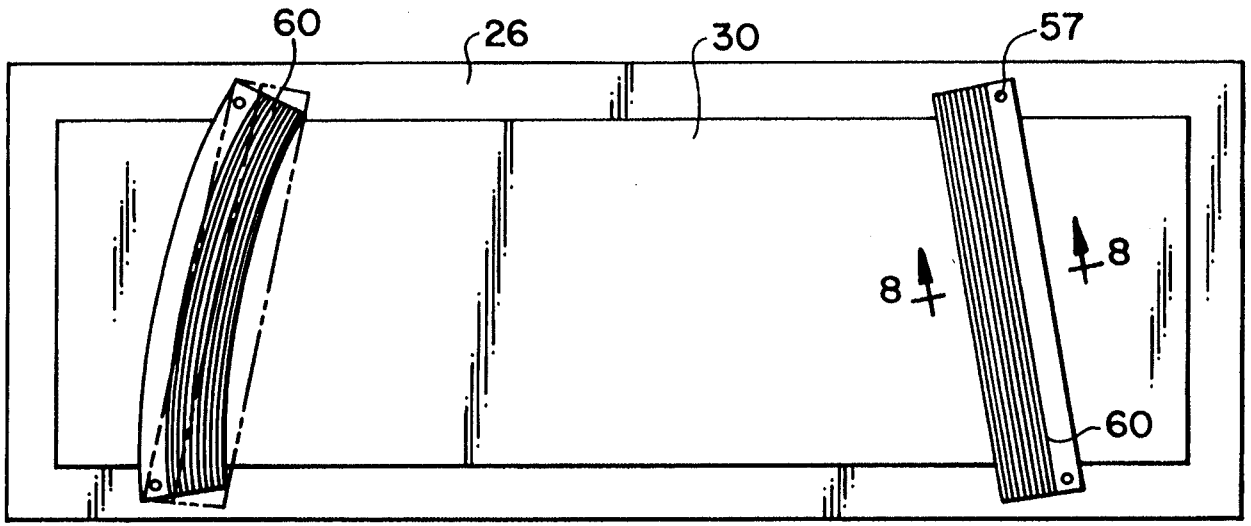
FIG. 7 is a top view of the embodiment of FIG. 5 including a friction pad.
Figure 11:
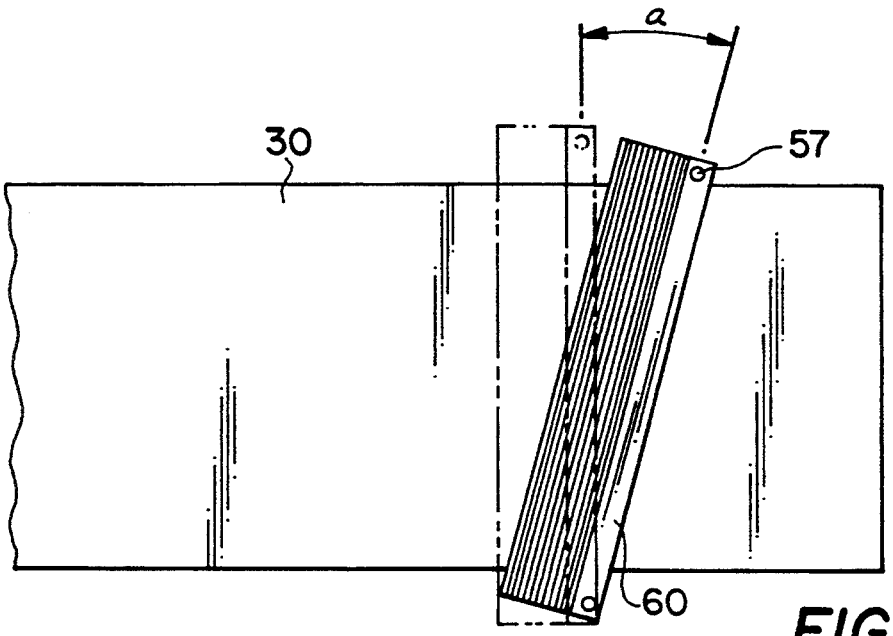
FIG. 11 is a top view of a portion of the invention according to the embodiment of FIG. 7.

When the clamping plate 50 is loosened from the bumper 60, the bumper 60 may be moved along the plastic sheet lengthwise to adjust the length of the slide board. Also, the bumper 60 can be angled to provide the desired toe-open angle as shown in FIGS. 7 and 11. The bolt holes 52 and the bolts 51 attached to the clamping plate 50 are spaced sufficiently to provide at least an 8° angle $\propto$ from the perpendicular with the plastic sheet as shown in FIG. 11. Thus, each bumper can be adjusted over about a 16 degree angle, from −8° to 8° relative to the perpendicular.

Specific embodiments will now be described with respect to the components of the present invention described above.

A first embodiment of the slide board apparatus is illustrated in FIGS. 1–4, and has two bumpers 10, each attached to an opposite end of a plastic sheet 30. The ends 34 of the plastic sheet 30 are not necessarily parallel, but are at an angle relative to each other. The relative angle is about 16 degrees, but can be in the range of 0 to 20 degrees. This relative angle provides for the proper toe-open angle when the bumpers are attached to the ends of the plastic sheet. The bumpers are attached by screws 33 from the bottom, or by any other adhesive means. The bumpers have an inclination angle 13 of 8 to 22 degrees, and preferably 20°. The bumpers 10 of the slide board apparatus may have any of the features described above, including the textured surface 14. The slide board with bumpers may be made to any dimensions, but is generally about seven feet long and two feet wide.

During use, the slide board apparatus has a tendency to move about on the floor as a user slides back and forth on the plastic sheet 33 and contacts the opposing bumpers 10. To prevent the slide board from moving over the underlying surface as a user slides back and forth and impacts the bumpers, a friction anchor can be used. Preferably, a friction pad 25 such as a common carpet underlayer may be placed under the plastic sheet 30 to prevent the unit from sliding. The friction anchor could alternately be tape, a velcro-type connection, or a cushion pad such as an underpad having a high friction surface.

One large pad can be placed under the entire sheet. Alternatively, two or more separate pads can be placed at locations under the sheet as shown in FIG. 3. For example, friction pads 25 can be placed under the sheet 25 by attaching one to each end of the sheet 25 under the bumpers 10. The pads may be attached to the plastic sheet by an adhesive or velcro. Alternatively, the pads may just be placed under the sheet without any attachment. The non-slip properties of the pad are sufficient to keep the pads in the proper position under the apparatus.

A second embodiment of the slide board apparatus is illustrated in FIGS. 5–8. The slide board has two bumpers 60 being adjustably bolt-mounted to the plastic sheet. The bumpers have a horizontal mounting flange portion 61 and are longer than the width of the plastic sheet 30 and each bumper 60 has holes 52 in the mounting flange at each end. Each bumper 60 has a clamping plate 50 to which the bumper 60 is clamped. The plastic sheet 30 extends between the bumper 60 and the clamping plate 50. By tightening the clamping plate 50 to the bumper 60, the bumper is fixed to the plastic sheet 30. Loosening the clamping plate allows the bumper to be moved along the sheet 30 to form the desired slide board length, and also the angles of the bumpers may be adjusted to achieve the desired toe-open angle as shown in FIG. 11. The adjustable bumpers 60 provide a toe-open adjustment range of 16° for each bumper.

Attaching the bumper 60 to a plastic sheet 30 by two bolts, one at each end as described above, provides a flexible bumper as shown in FIG. 7. The flexible bumper 60 elastically flexes in the direction of motion of the foot, when a user's foot impacts the bumper. The bumper deflects in the center, thus absorbing the kinetic energy of the user over a distance. The elastic deflection decreases the severity of the impact and diminishes the shock to the foot, ankle, knee and hip. The flexing action of the bumper is also particularly beneficial in rehabilitating injuries and also provides a more realistic motion for modeling some exercises, for example, cross-country skiing. The amount of flex action of the bumper can be altered by changing the distance of separation of the bolts or even the tightness of the bolts. The stiffness of the bumper 60 can also be altered by changing the material or width of the bumper, or the thickness of the mounting flange. Alternatively and preferably, the stiffness of the flexible bumper is adjustable by providing a means to attach a stiffening member to the bumper as shown in FIG. 8. The stiffening means of the present invention is a vertical slot or groove 64 in the mounting flange portion 61 which extends along substantially the entire length of the bumper. A stiffening member 65 is inserted into the groove to contribute stiffness to the bumper. The groove 64 may be of any appropriate width, but preferably is in the range of approximately $\frac{1}{8}$ to $\frac{1}{2}$ of an inch and more preferably about 3/16 of an inch wide. The groove may also be of any appropriate depth, but preferably is in the range of approximately $\frac{1}{4}$ to $\frac{3}{4}$ of an inch and preferably not more than $\frac{1}{2}$ of the thickness of the flange.

Figure 9:
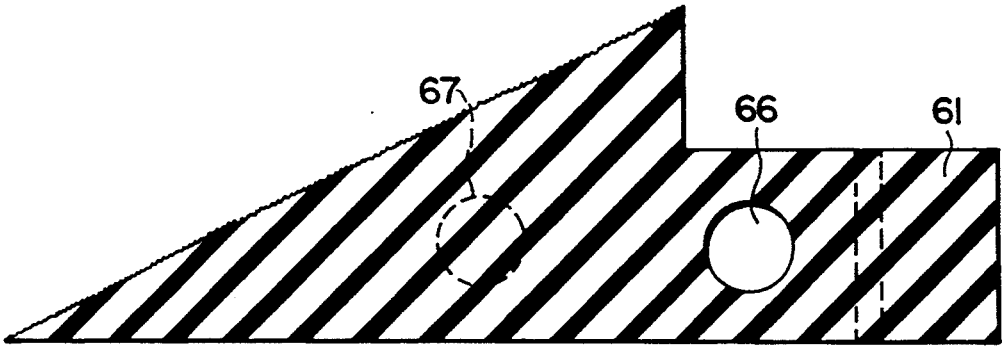
FIG. 9 is a cross sectional view of an alternate embodiment to the bumper of FIG. 8.

Alternatively, a hollow channel such as a round hole can be formed along the length of the bumper as illustrated in FIG. 9. Such a channel can be formed in the mounting flange portion 66 of the bumper as illustrated by the solid line in FIG. 9, or in the main body 67 of the bumper itself as shown by the darted line in FIG. 9. The channel 66, 67 need not be round, but can be of any shape. A stiffening member of a corresponding shape is inserted into the channel to provide the desired stiffening properties.

A number of different types of stiffening members can be inserted into the groove or hollow channel to provide the proper stiffness of the bumper. For example, a steel member may be used to provide very little flexibility or a substantially rigid bumper. Alternatively, a plexiglass or plastic member can be used to provide more flexibility. There is, of course, a broad range of possible stiffening materials. Also, the dimensions of the stiffening members can be altered to provide the proper stiffening characteristics. Factors determining the appropriate stiffness of the bumper include the nature of the exercises and the weight of the user.

The adjustable and flexible bumper slide apparatus has a non-slip means for preventing the apparatus from moving over the floor during use as shown in FIGS. 7 and 8. The non-slip means is a non-slip pad 26 as described above referring to the embodiment of FIG. 3. The pad 26 can be placed under the entire apparatus as shown in FIG. 7, or portions of pad can be placed under or attached to the bumper areas of the apparatus as described above referring to the embodiment of FIG. 3.

Figure 12:
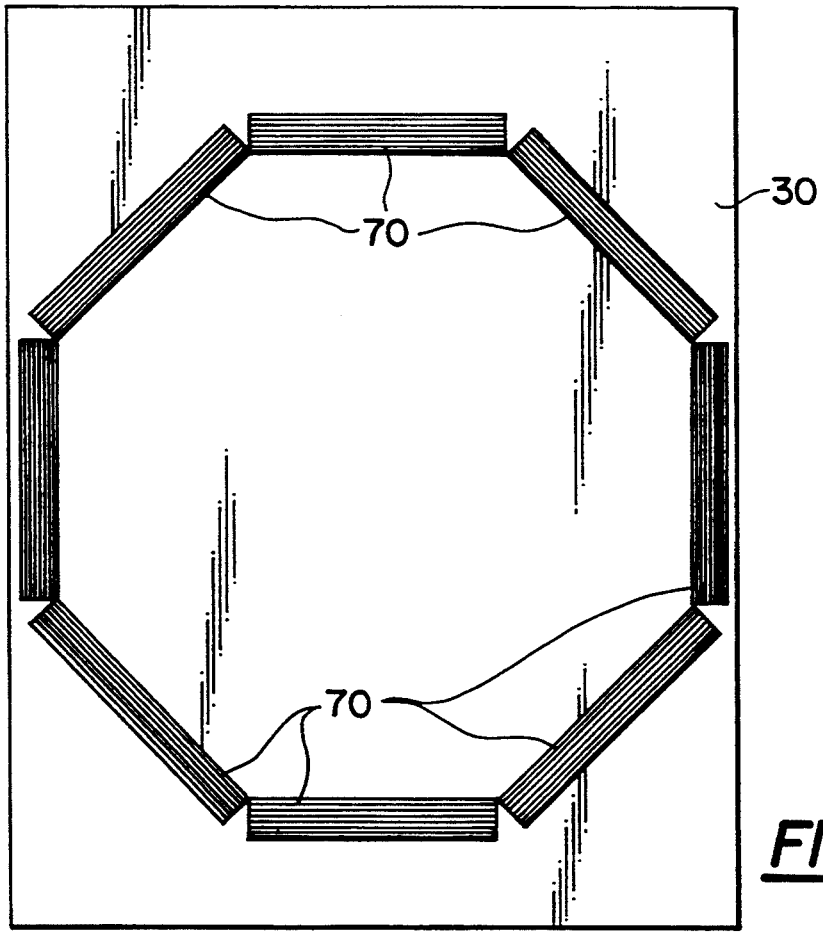
FIG. 12 is a top view of a third embodiment of the present invention.

A third embodiment of the present invention is illustrated by FIG. 12. This embodiment is a slide board having more than two bumpers 70, of any of the types described above, configured such that the bumpers completely enclose a sliding space. Preferably, the bumpers are of the type attached to the plastic sheet by a plurality of screws. By enclosing a slide board area completely with bumpers, the present invention increases the versatility of the slide board by allowing movement in all directions, including forward and backward. The length and number of bumpers are chosen to define an enclosed slide board surface which is appropriate for the exercise, and the constraints of the exercise room.

A sliding surface of any size or any polygonal shape including a triangle, rectangle, pentagon, heptagon, or octagon can be formed by enclosing the perimeter of the slide board with a plurality of bumpers. Such an omnidirectional slide board allows for a great variety of exercises which place demanding load on the legs. Although only a single enclosed slide board is illustrated, an enclosed slide board of any shape or size having more or fewer sides is intended.

For example, a octagonal slide board can be formed by attaching eight bumpers 70 to a single plastic sheet 30, as shown in FIG. 12. The bumpers can be attached to the sheet by any of the methods described above, but preferably by a number of screws. Also, the bumpers of the omnidirectional slide board may be of the flexible type described above.

The plastic sheets for such omnidirectional slide boards are formed by welding rectangular sheets together to form a single surface of the desired size and shape.

The enclosed slide board also has a non-slip means as described above regarding the first and second embodiments. A single pad (not shown) is placed under the slide board, or alternatively, a plurality of pads (not shown) may be placed under, or attached to, sections of the underside of the apparatus.

Figure 13:
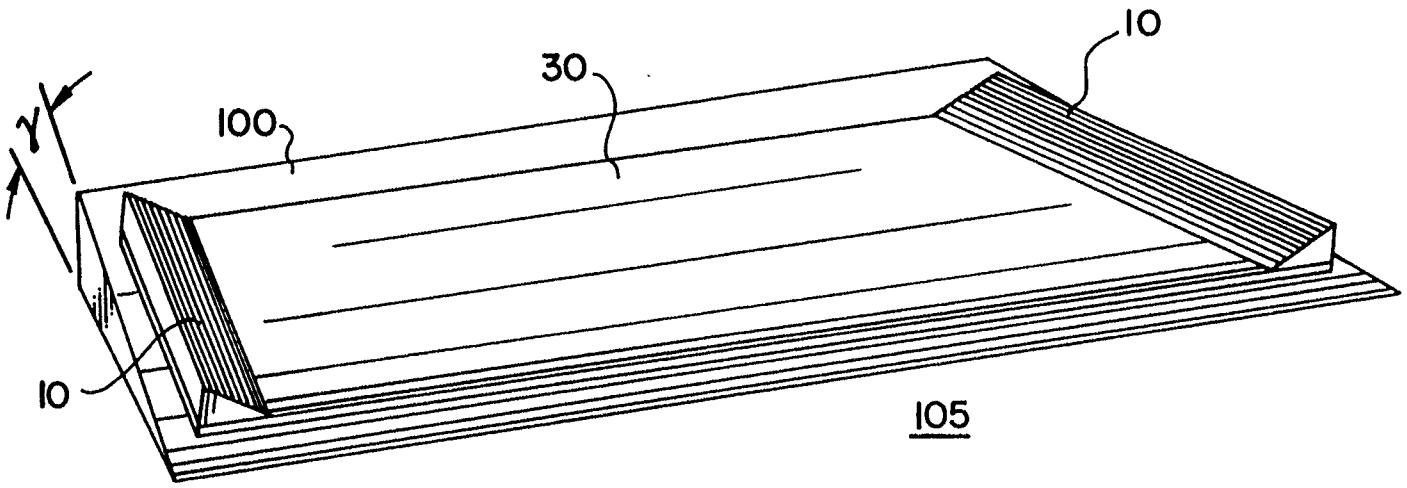
FIG. 13 is a perspective view of a further embodiment of the present invention.

A fourth embodiment relates to a feature illustrated in FIG. 13 which is applicable to any of the embodiments described above. The whole slide board apparatus including the bumpers 10 and the plastic sheet 30, is inclined relative to a horizontal surface 105 such that a user of a two-bumper slide board would be facing down the incline. Such an incline gives the user a feeling of descent during use. This orientation of the slide board approximates the feeling of a number of exercises including alpine or cross-country skiing. The incline is formed by placing the slide board on a rigid surface 100 and angling the surface to the desired degree. The angle of inclination $\gamma$ of the apparatus depends upon the steepness of the hill to be simulated. For example the angle of inclination $\gamma$ may be in the range of about 2 to 15 degrees. To prevent the user from sliding down the incline during use, the toe-open angle of the bumpers 10 is set to provide a force component upward along the incline when the user pushes off. The slide board apparatus can be turned around so as to face up the incline to give the sensation of exercising up a hill.

The bumpers described above, both with and without the attached mounting flange, being flexible or rigid and having the various angles of inclination, and textured and untextured surfaces, may be attached to the plastic sheets or base of a slide board by any of the methods described above, including screws or bolts through the bumper and the plastic sheet, which allows for adjustment of the length of the slide board and also the toe-open angle. Any of the bumper types and attachment means described in this application may also be used to form an enclosed slide board of any size and shape as described above. Additionally, any of the slide boards of the combinations mentioned above may be inclined in any direction to any degree to provide the proper dynamics for a particular exercise.

While the invention has been described in connection with what are presently considered to be the most practical and preferred embodiments, it is to be understood that the invention is not to be limited to the disclosed embodiments, but on the contrary is intended to cover various modifications and equivalent arrangements included within the spirit and scope of the appended claims.

What is claimed is:

1. An exercise apparatus comprising:

a smooth sheet having a sliding surface adapted for sliding;

a plurality of bumpers disposed upon the sliding surface, each bumper having a bottom surface which contacts the sliding surface, a back surface, and an inclined surface, said inclined surface being inclined at an angle of about 18 to 22 degrees relative to the bottom surface such that the inclined surface has one edge in common with the bottom surface, at least a substantial portion of each said bumper being formed from a flexible, elastic material whereby, when a user's foot impacts the bumper, the bumper elastically flexes in a direction of motion of the foot, whereby the force of impact and associated shock to the foot, leg and joints is decreased.

2. An exercise apparatus as in claim 1, wherein each bumper has an inclined surface at an angle of substantially 20 degrees relative to the bottom surface.

3. An exercise apparatus as in claim 1, wherein the inclined plane has a textured surface comprising a plurality of spaced ridges which extend along a lengthwise direction of the bumper.

4. An exercise apparatus as in claim 1, wherein each bumper further comprises a mounting flange extending from the back surface, the mounting flange having a horizontal upper surface.

5. An exercise apparatus as in claim 1, wherein there are two of said bumpers, wherein one bumper is located at a first edge of the smooth sheet and a second bumper is located at a second and opposite edge of the smooth sheet such that the bumpers extend in a width direction along two edges of the smooth sheet, and such that the inclined surfaces of the two bumpers face each other.

6. An exercise apparatus as in claim 1, further comprising a high friction means disposed between the smooth sheet and a floor to prevent the apparatus from sliding across the floor during use.

7. An exercise apparatus as in claim 1, wherein each bumper is attached to the smooth sheet only at ends of the bumper, whereby upon lateral impact by the user's foot, with sufficient force, against a central portion of the bumper, at least the central portion of the bumper deflects laterally relative to said smooth surface and to the ends of the bumper in the direction of impact.

8. An exercise apparatus as in claim 1, wherein the plurality of bumpers form a substantially enclosed sliding surface upon the smooth sheet.

9. An exercise apparatus as in claim 3, wherein each bumper further comprises a mounting flange extending from the back surface, the mounting flange having a horizontal upper surface.

10. An exercise apparatus as in claim 4, wherein each bumper has a length greater than a width of the smooth sheet.

11. An exercise apparatus as in claim 5, wherein the first and second opposite edges of the smooth sheet are not parallel, but define an angle of substantially 20 degrees such that each edge forms an acute angle of approximately 10 degrees with a line perpendicular to a line in a lengthwise direction of the smooth sheet.

12. An exercise apparatus as in claim 6, wherein the high friction means is a non-slip material attached to a bottom surface of the smooth sheet.

13. An exercise apparatus as in claim 7, wherein each bumper further comprises a stiffness adjusting means.

14. An exercise apparatus as in claim 13, wherein the stiffness adjusting means is a hollow channel passing through the length of the bumper and a stiffening member, inserted in the hollow channel.

15. An exercise apparatus as in claim 8, wherein the bumpers form a triangular sliding surface.

16. An exercise apparatus as in claim 8, wherein the bumpers form a rectangular or square sliding surface.

17. An exercise apparatus as in claim 8, wherein the bumpers form a pentagonal sliding surface.

18. An exercise apparatus as in claim 8, wherein the bumpers form a hexagonal sliding surface.

19. An exercise apparatus as in claim 8, wherein the bumpers form an octagonal sliding surface.

20. An exercise apparatus as in claim 9, wherein each bumper has two spaced holes in the mounting flange, each bumper further comprising a clamping plate, the spaced holes in each bumper equally spaced by an amount greater than the width of the smooth sheet, the smooth sheet passing between the bumper and the clamping plate.

21. An exercise apparatus as in claim 20, wherein the attachment means comprises:

two bolts attached to the clamping plate, each bolt passing through one of the spaced holes in the mounting flange; and two threaded knobs engageable with the bolts, such that by loosening the knobs, the position and angle of the bumpers relative to each other is adjustable.

22. An exercise apparatus as in claim 13, wherein the stiffness adjusting means is a vertical slot extending along a length of the bumper and a stiffening member inserted in the slot.

23. An exercise apparatus as in claim 22, wherein the vertical slot is along a mounting flange.

24. An exercise apparatus as in claim 23, wherein the vertical slot is located adjacent to the attachment means.

25. An exercise apparatus as in claim 23, wherein the vertical slot is less than approximately one-half of a height of the mounting flange and is approximately $\frac{1}{8}$ to $\frac{1}{2}$ inch wide.

26. An exercise apparatus comprising:

a smooth sheet having a sliding surface adapted for sliding;

a plurality of bumpers at edges of the sliding surface, each bumper having a bottom surface which contacts the sliding surface, a back surface, and an inclined surface such that the inclined surface has one edge in common with the bottom surface, the inclined surface having a textured surface for providing frictional resistance to sliding across the surface; and an attachment means for attaching the bumpers to the smooth sheet, at least a substantial portion of each said bumper being formed from a flexible, elastic material whereby, when a user's foot impacts the bumper, the bumper elastically flexes in a direction of motion of the foot, whereby the force of impact and associated shock to the foot, leg and joints is decreased.

27. An exercise apparatus as in claim 26, wherein the textured surface comprises a plurality of spaced ridges extending along a lengthwise direction of the bumper.

28. An exercise apparatus as in claim 27, wherein the inclined surface has a smooth part near the plastic sheet, and gradually and continuously becomes increasingly textured towards the back surface.

29. An exercise apparatus comprising:

a smooth sheet having a sliding surface adapted for sliding;

a plurality of bumpers at edges of the sliding surface, each bumper comprising:

a bumper portion having a bottom surface which contacts the smooth sheet, a back surface, and an inclined surface; and a mounting portion integral with the bumper portion, the mounting portion extending from the back surface of the bumper portion and having a horizontal upper surface; and an attachment means for attaching the bumpers to the smooth sheet., at least a substantial portion of each said bumper being formed from a flexible, elastic material whereby, when a user's foot impacts the bumper, the bumper elastically flexes in a direction of motion of the foot, whereby the force of impact and associated shock to the foot, leg and joints is decreased.

30. An exercise apparatus as in claim 29, wherein the mounting portion has two vertical holes passing there through at ends of the mounting portion.

31. An exercise apparatus as in claim 30, wherein the attachment means further comprises a clamping plate having two bolts passing through the two vertical holes of the mounting portion.

32. An exercise apparatus comprising:

a smooth sheet for sliding upon;

a plurality of bumpers at edges of the smooth sheet, each bumper being attached to the smooth sheet only at ends of the bumper, at least a substantial portion of each said bumper being formed from a flexible, elastic material whereby, when a user's foot impacts the bumper, the bumper elastically flexes in a direction of motion of the foot and such that upon lateral impact of the foot with a central portion of the bumper, with sufficient force, at least the central portion of the bumper deflects in the direction of impact, whereby the force of impact and associated shock to the foot, leg and joints is decreased.

33. An exercise apparatus as in claim 32, wherein further comprising a flexibility adjusting means for selectively adjusting the flexibility of the bumper.

34. An exercise apparatus as in claim 33, wherein the flexibility adjusting means comprises a groove or channel extending longitudinally in the bumper wherein a stiffening member is inserted.

35. An exercise apparatus comprising:

a smooth sheet having a sliding surface adapted for sliding;

a plurality of bumpers attached to the sliding surface such that the bumpers form a substantially enclosed sliding surface, at least a substantial portion of each said bumper being formed from a flexible, elastic material whereby, when a user's foot impacts the bumper, the bumper elastically flexes in a direction of motion of the foot, whereby the force of impact and associated shock to the foot, leg and joints is decreased.

36. An exercise apparatus as in claim 35, wherein the bumpers form a triangular sliding surface.

37. An exercise apparatus as in claim 35, wherein the bumpers form a rectangular or square sliding surface.

38. An exercise apparatus as in claim 35, wherein the bumpers form a pentagonal sliding surface.

39. An exercise apparatus as in claim 35, wherein the bumpers form a hexagonal sliding surface.

40. An exercise apparatus as in claim 35, wherein the bumpers form an octagonal sliding surface.

41. An exercise apparatus comprising:

a smooth sheet having a sliding surface adapted for sliding;

a plurality of bumpers at edges of the sliding surface, each bumper having a bottom surface which contacts the sliding surface, a back surface, and an inclined surface such that the inclined surface has one edge in common with the bottom surface, at least a substantial portion of each said bumper being formed from a flexible, elastic material whereby, when a user's foot impacts the bumper, the bumper elastically flexes in a direction of motion of the foot, whereby the force of impact and associated shock to the foot, leg and joints is decreased; and an attachment means for attaching the bumpers to the smooth sheet, the entire apparatus being inclined such that a plane of the sliding surface forms an acute angle with a horizontal surface.

42. An exercise apparatus as in claim 41 wherein the acute angle is in the range of substantially 2 to 15 degrees.

43. An exercise apparatus as in claim 41 comprising two opposing bumpers, the apparatus being inclined such that a line perpendicular to a line extending directly between the bumpers forms an acute angle with the horizontal surface, such that a user faces up or down the incline while positioned to slide between the bumpers.

44. An exercise apparatus as in claim 41 further comprising an inclined rigid support surface disposed between a lower surface of the apparatus and the horizontal surface.

* * * * *